US006401727B1

(12) United States Patent
Carroll

(10) Patent No.: US 6,401,727 B1
(45) Date of Patent: Jun. 11, 2002

(54) CHILDREN'S HYGIENIC STORAGE CONTAINER

(75) Inventor: David T. Carroll, Schofield, WI (US)

(73) Assignee: Preventive Dental Specialties, Inc., Weston, WI (US)

( * ) Notice: Subject to any disclaimer, the term of this patent is extended or adjusted under 35 U.S.C. 154(b) by 0 days.

(21) Appl. No.: 09/710,777

(22) Filed: Nov. 9, 2000

(51) Int. Cl.[7] ..... A45D 40/00; A61L 2/00; B65D 51/16

(52) U.S. Cl. ..... 132/286; 422/300; 215/309

(58) Field of Search ..... 132/286, 333; 215/309; 220/23.88, 367.1; 422/300; 206/362.1, 362.2

(56) References Cited

U.S. PATENT DOCUMENTS

| | | | | | |
|---|---|---|---|---|---|
| 1,995,972 | A | * | 3/1935 | Ehrlich | 206/505 |
| 2,197,066 | A | | 4/1940 | Brody | |
| 2,564,472 | A | | 8/1951 | Farnham | |
| 2,608,294 | A | | 8/1952 | Ward | |
| 3,648,400 | A | | 3/1972 | Wolfe | |
| 3,776,694 | A | | 12/1973 | Leittl | |
| 3,853,365 | A | | 12/1974 | Nielsen | |
| 4,432,529 | A | * | 2/1984 | McMillan | 249/52 |
| 4,519,500 | A | * | 5/1985 | Wilson | 206/505 |
| D291,268 | S | * | 8/1987 | Stephenson | D6/512 |
| 4,854,475 | A | | 8/1989 | Riihimaki et al. | |
| 4,959,199 | A | | 9/1990 | Brewer | |
| 4,986,759 | A | | 1/1991 | Duncan | |
| 5,165,539 | A | * | 11/1992 | Weber et al. | 206/363 |
| 5,540,901 | A | | 7/1996 | Riley | |
| 5,630,505 | A | * | 5/1997 | Garcia | 206/362.1 |
| 5,893,618 | A | | 4/1999 | LePage, Jr. et al. | |
| 5,896,987 | A | | 4/1999 | Bettenhausen | |
| 5,975,660 | A | | 11/1999 | Tisbo et al. | |

* cited by examiner

*Primary Examiner*—John J. Wilson
*Assistant Examiner*—Robyn Kieu Doan
(74) *Attorney, Agent, or Firm*—Lathrop & Clark LLP

(57) ABSTRACT

Multiple plastic trays are covered with pivotable lids. Each tray is divided into distinct compartments into which infant and toddler toothbrushes, teething rings, pacifiers, or other such personal hygiene products may be placed. The lid is punctured by an array of air holes, which allow moisture to escape from the covered tray, while at the same time protecting the tray contents from contamination. The covered trays are received within an open front rack in a vertically spaced arrangement. Air cavities defined between stacked trays permit natural air flow over the trays, and the removal of moisture from the tray contents. A fan may be attached to the rear of the rack to blow air over the lids and to draw the moist air from within the compartments through the lid air holes.

23 Claims, 2 Drawing Sheets

CHILDREN'S HYGIENIC STORAGE CONTAINER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to specialized storage containers in general, and to containers for articles which come in contact with children's mouths in particular.

Proper oral hygiene, when pursued consistently, can contribute to healthy gums and teeth. Regular brushing of teeth, carried out from the earliest ages, helps to develop proper tooth care habits which persist through life. Persistent application of dental hygiene is associated with reduced levels of tooth and gum decay.

As an encouragement to proper oral hygiene habit development, even infants and toddlers should brush their teeth as soon as they are able. In many circumstances young children find themselves outside the home at snack- or meal-time. At preschools, day-care centers, Head Start programs, kindergartens and other social settings, many children partake of food which calls for subsequent toothbrushing. In order to provide adequate tooth care apparatus for all children, it is common for the school or day-care facility to retain on-site individual toothbrushes for each child. However, to restrain the spread of disease, it is important that toothbrushes are specifically associated with a particular child and are not exchanged. Not only that, but contamination between the brushes must be avoided as well. Furthermore, to prevent the growth of bacteria on the damp bristles, there must be an opportunity for the brushes to dry rapidly, even under humid conditions.

In some locations, brushes are stored in upright cylinders similar to test tubes, with the bristles projecting upwardly. To protect the bristles from insects a net is then placed over the array of cylinders. Such an arrangement can be unstable, and the net itself can be a vector of contamination.

What is needed is a container for personal care products for children, including infants and toddlers, which is hygienic, easy to maintain, and which promotes air drying of the contents.

SUMMARY OF THE INVENTION

The children's personal hygiene storage container of this invention has multiple trays which are covered with pivotable lids. Each tray is divided into distinct compartments into which toothbrushes, teething rings, pacifiers, or other such personal hygiene articles may be placed. The lid is punctured by an array of air holes, which allow moisture to escape from the covered tray, while at the same time protecting the tray contents from contamination. The covered trays are received within an open front rack in a vertically spaced arrangement. Air cavities defined between stacked trays permit natural air flow over the trays, and the removal of moisture from the tray contents. A fan may be attached to the rear of the rack to blow air over the lids and to draw the moist air from within the compartments through the lid air holes.

It is an object of the present invention to provide a storage cabinet for infant and toddler toothbrushes and other personal care articles which keeps the articles of one user separated from those of another.

It is a further object of the present invention to provide a storage container for infant and toddler personal care products which simultaneously protects the products from exterior contamination while at the same time allows the exhaustion of moisture laden air.

It is another object of the present invention to provide a storage container for infant and toddler toothbrushes and personal care articles which promotes the air drying of the container contents even in humid environments.

Further objects, features and advantages of the invention will be apparent from the following detailed description when taken in conjunction with the accompanying drawings.

DESCRIPTION OF THE PREFERRED EMBODIMENTS

Figure 1:
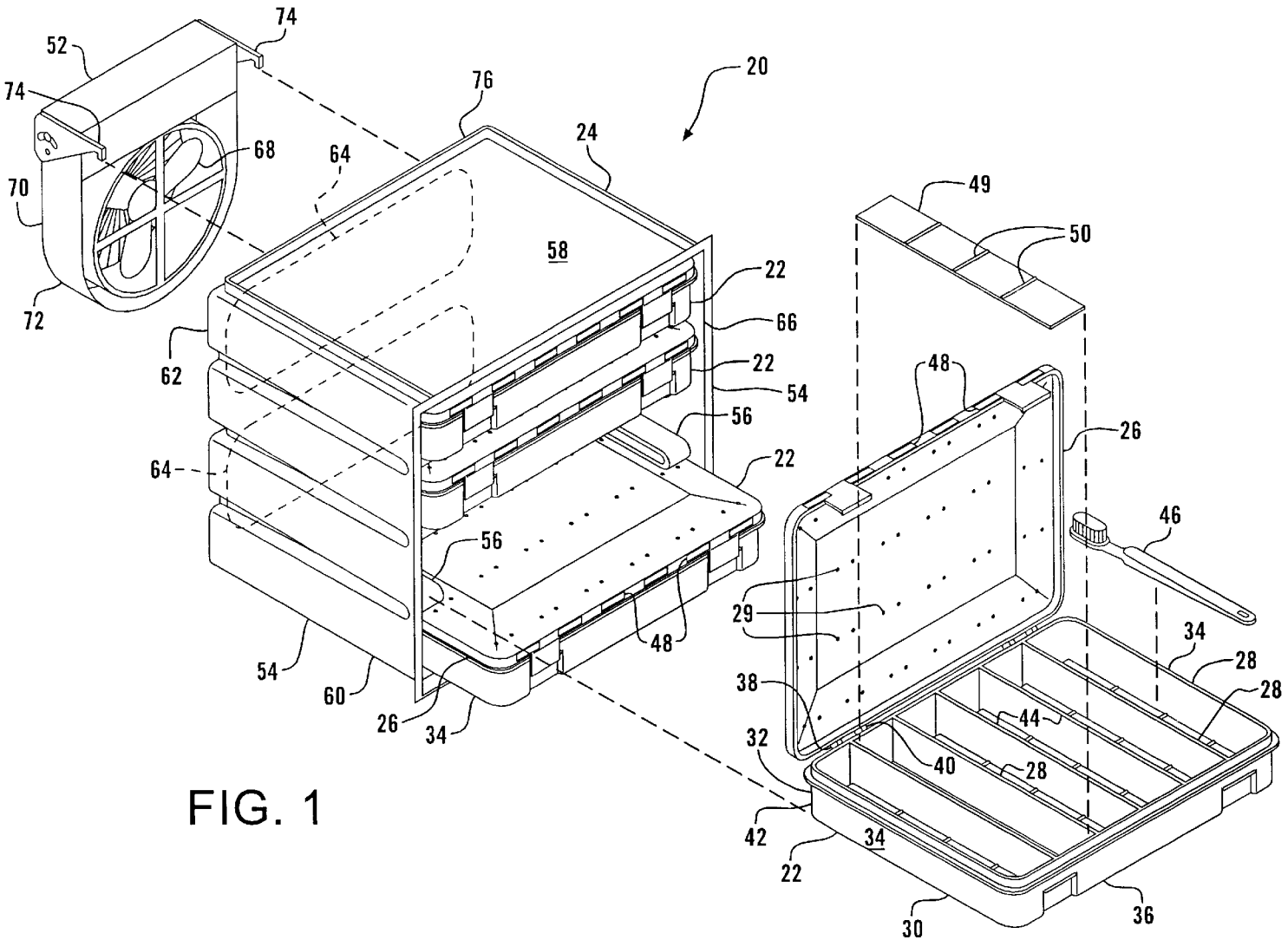
FIG. 1 is an exploded isometric view of the children's hygienic storage container of this invention.
Figure 2:
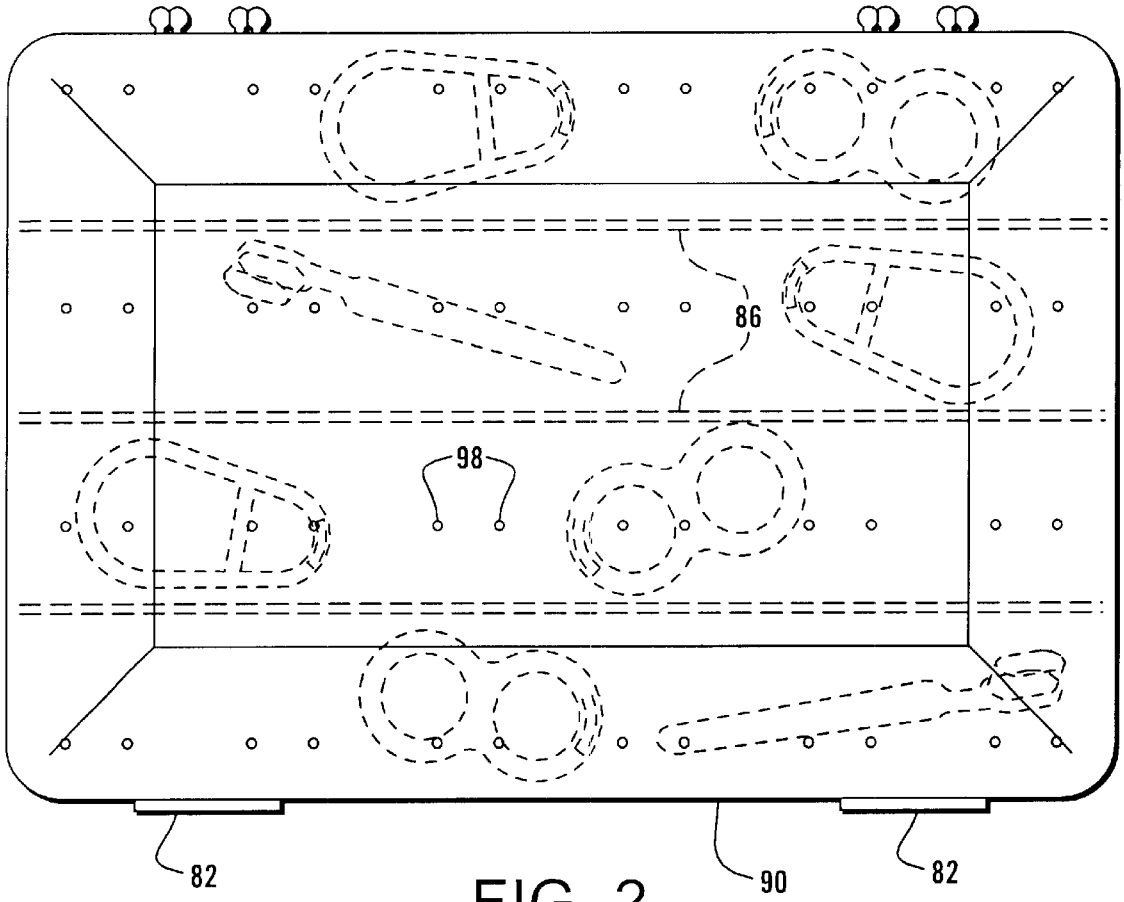
FIG. 2 is a top view of a covered drawer for an alternative embodiment infant and toddler tooth care hygienic storage container of this invention.
Figure 3:
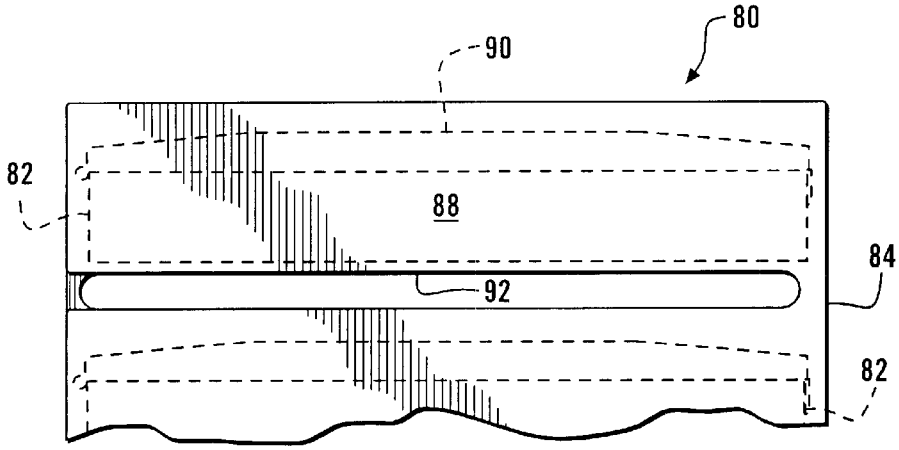
FIG. 3 is a fragmentary side elevational view of the chest into which the drawer of FIG. 2 extends.

Referring more particularly to FIGS. 1–3 wherein like numbers refer to similar parts, a children's hygienic storage container 20 of this invention is shown in FIG. 1. The container is particularly adapted to storage of infant and toddler tooth care articles. The container 20 has multiple lidded trays 22 which are retained in a vertical array within a rack 24. Each tray 22 has a pivotable hinged lid 26 which can be closed to seal a number of distinct compartments 28. The lid 26 has multiple air holes 29 positioned over each compartment 28.

Each tray 22 is a rectangular box having a bottom wall 30 from which a rear wall 32, two side walls 34, and a front wall 36 extend upwardly. The lid 26 is preferably formed with hinge knuckles 38 which snap into engagement with hinge knuckles 40 formed at the top of the tray rear wall 32. Snap closures 42 are formed on the lid 26 and the front wall 36 of the tray 22 to allow the lid to be secured to the tray in a closed condition. Partitions 44 extend upwardly from the bottom wall to the level of the closed lid 26. The partitions 44 extend from the rear wall 32 to the front wall 36. The compartments 28 are thus defined between the front wall, the rear wall, and the partitions and the side walls. When the lid is closed, each compartment 28 is isolated from the others. Even if the covered tray is inverted with the lid closed, the contents of the compartments 28 are not able to mingle. The compartments 28 extend from front to back and each is suited for receiving an individual child's toothbrush 46. The lidded tray is preferably formed of injection molded parts and maybe formed of translucent PVC plastic. A lidded tray of this sort is available from the Plano Molding Co., Plano, Ill., in the Plano 3600 series containers. The lid is thus connected to the tray to be movable between a first position in which the lid covers the plurality of compartments, and a second position in which access is permitted to the plurality of compartments.

Although it is important to segregate the contents of each compartment from the other compartments, it is also important to provide for the escape of water vapor from within each compartment. Typically a toothbrush 46 will be damp after use as it is placed into a compartment for storage. If the compartment is sealed to the outside atmosphere, the water on the toothbrush bristles will not be able to escape. The air holes 29 are large enough to permit the escape of water vapor, but small enough to prevent the entrance of cockroaches, spiders, and similar pests. Preferably, eight air holes 29 are positioned over each compartment 28. Each hole has a diameter of between about 0.040 inches and about 0.090 inches, and preferably between about 0.060 inches and about 0.080 inches.

The lid over each compartment has more than one air hole formed therein, and in the illustrated preferred embodiment has at least eight holes. The holes may be formed in an array of two columns of four rows of holes, with the two columns being about ½ inch apart, and the first row being about 1 and 11/32 inches from the second row, the second row being 2 and 1/32 inches from the third row, and the third row being 1 and 11/32 inches from the fourth row. The distance between the rightmost column of a first compartment lid hole array and the hole array over an adjacent compartment is about 1 and 1/32 inches. The thickness of the lid is about 1/32 inch where the holes pierce the lid.

To facilitate drying of the brushes, inserts 49 with three ribs 50 are positioned over the bottom wall 30 of the tray within each compartment 28. The inserts 49 may be thermoformed plastic. The ribs 50 support the brushes above the bottom wall, keeping them out of contact with liquid water which may pool within the compartment. When the inserts are positioned within a compartment, the insert supports the oral hygiene article so that it is not in continuous contact with an underlying support surface. The inserts 49 are low cost, and hence readily disposable, allowing replacement, for example, after a child's illness.

A pressure sensitive name label 48 is adhered to the lid, as shown in FIG. 1, or to the front wall 36 adjacent each compartment 28. The name labels 48 are marked with the name of the child whose toothbrush is stored in that compartment 28. The labels provide indicia which help to associate a particular compartment with a particular child's oral hygiene articles. The trays 22 provide convenient storage for multiple toothbrushes, and may be readily transported within a facility without danger of contamination. At the point of distribution the lid may be opened and the toothbrushes dispensed to their owners.

Storage of the lidded trays 22 within the rack 24 provides adequate continuous ventilation to ensure that the toothbrush bristles are dried within a reasonable period of time. This ventilation may be natural, or it may be assisted by a fan 52, as shown in FIG. 1. The rack 24 has two parallel upwardly extending side panels 54 which support inwardly protruding horizontal rails 56. Opposed pairs of rails 56 support the underside of a tray bottom wall 30. The side panels 54 of the rack 24 are joined by an overlying top panel 58 and an underlying bottom panel 60. A rear panel 62 extends between the top, bottom, and side panels at the rear. The rear panel 62 preferably has two rear openings 64 which communicate with the cavities 66 defined between two neighboring trays. The cavities 66 correspond to the volume between the spaced rails 56.

In dry climates, the air cavities 66 alone may be adequate to allow the evaporative escape of liquid from the toothbrushes within the compartments. However, in humid climates, a fan 52 may be provided. The fan 52 has a DC motor which may be driven by batteries or a converter from AC current. A fan blade 68 rotates within a fan housing 70 which includes a shroud 72 which directs air flow into the rear openings 64 of the rear panel 62. The shroud may be generally cylindrical, as shown, or may be formed to be generally rectangular to make a more complete fit over the rear panel openings. The fan housing 70 has two projecting hooks 74 which clip to the rack 24, for example hooking over a rim 76 which protrudes above the top panel 58 at the rear of the rack. When activated, the fan drives air across the lids 26 of the trays, and, through a Venturi effect, drawis air upwards through the air holes 29 and exhausts it out the front of the rack.

The rack, the trays and the lids are preferably formed of dishwasher safe materials, such as PVC plastic, so that all components of the container 20 are readily cleaned.

An alternative embodiment storage container 80 is shown in FIGS. 2 and 3. The storage container 80 has multiple trays 82 which are slidably received within a plastic rack 84. The trays 82 are generally similar to the trays 22, but are provided with elongated compartments 86 which extend from side to side. The longer compartments are better suited to receiving the many personal products required by infants and younger children, for example teething rings, pacifiers, and teething brushes such as my infant and toddler teething brush disclosed in my U.S. Pat. No. 5,048,143. The side panels 88 of the rack 84 may be unperforated, similar to the rack 24, however, to promote ventilation across the lids 90 of the trays 82, side openings 92 are formed in the side panels at locations corresponding to the rails 94, as shown in FIG. 3.

As shown in FIG. 2, each lid 90 is hinged to the tray 82 and has closures 96 which permit the lid to be closed on the tray 82. The lid 90 is provided with a single array of air holes 98 which provide ventilation to the compartment interiors.

The air holes 98 in the lids may be formed in the molding process, or, in an approach which does not require modification of the mold, a jig may be prepared which simultaneously punches all the holes in a lid at once. For convenience in preparing the two different embodiments illustrated, the holes may be formed in an array which is identical on both types of tray lids, with a 90 degree turn of the jig in order to form a single line of holes in the left to right extending compartments of the tray 82, or the double arrays of holes in the tray 22.

It is understood that the invention is not limited to the particular construction and arrangement of parts herein illustrated and described, but embraces such modified forms thereof as come within the scope of the following claims.

I claim:

1. A container for children's oral hygiene articles, comprising:

a tray having a bottom wall with side walls, a rear wall, and a front wall which extend upwardly from the bottom wall, and having a plurality of partitions which extend upwardly from the bottom wall to define a plurality of compartments within the tray which are separated from one another;

children's oral hygiene articles disposed within the plurality of compartments;

a lid which is connected to the tray to be movable between a first position in which the lid covers the plurality of compartments, and a second position in which access is permitted to the plurality of compartments;

portions of the lid which define a plurality of air holes formed above each of the plurality of compartments in the first position;

indicia on the container corresponding to each compartment, the indicia indicating the identity of the owner of oral hygiene articles contained within that compartment.

2. The container of claim 1 wherein each air hole has a diameter of from about 0.060 to about 0.080 inches.

3. The container of claim 1 wherein there are at least eight air holes formed in the lid above each compartment in the lid first position.

4. A container for children's oral hygiene articles, comprising:

a tray having a bottom wall with side walls, a rear wall, and a front wall which extend upwardly from the bottom wall, and having a plurality of partitions which extend upwardly from the bottom wall to define a plurality of compartments within the tray which are separated from one another;

a lid which is connected to the tray to be movable between a first position in which the lid covers the plurality of compartments, and a second position in which access is permitted to the plurality of compartments;

portions of the lid which define a plurality of air holes formed above each of the plurality of compartments in the first position, each air hole being from about 0.040 to 0.090 inches in diameter;

indicia affixed to the lid corresponding to each compartment, the indicia indicating the identity of the owner of the oral hygiene articles contained within that compartment.

5. A container for children's oral hygiene articles, comprising:

a tray having a bottom wall with side walls, a rear wall, and a front wall which extend upwardly from the bottom wall, and having a plurality of partitions which extend upwardly from the bottom wall to define a plurality of compartments within the tray which are separated from one another;

a lid which is connected to the tray to be movable between a first position in which the lid covers the plurality of compartments, and a second position in which access is permitted to the plurality of compartments;

portions of the lid which define a plurality of air holes formed above each of the plurality of compartments in the first position, each air hole being from about 0.040 to 0.090 inches in diameter;

a compartment insert removably positioned within each compartment, the compartment insert having a plurality of upwardly extending ribs, such that when positioned within a compartment the insert supports the oral hygiene article so that it is not in continuous contact with an underlying support surface.

6. The container of claim 1 further comprising a rack having two spaced side panels, with at least one rail extending inwardly from each of the side panels, the bottom wall of the tray being supported on the rack rails.

7. A container for children's oral hygiene articles, comprising:

a tray having a bottom wall with side walls, a rear wall, and a front wall which extend upwardly from the bottom wall, and having a plurality of partitions which extend upwardly from the bottom wall to define a plurality of compartments within the tray which are separated from one another;

a lid which is connected to the tray to be movable between a first position in which the lid covers the plurality of compartments, and a second position in which access is permitted to the plurality of compartments;

portions of the lid which define a plurality of air holes formed above each of the plurality of compartments in the first position, each air hole being from about 0.040 to 0.090 inches in diameter;

a rack having two spaced side panels, with at least one rail extending inwardly from each of the side panels, the bottom wall of the tray being supported on the rack rails;

portions of the rear panel which define an air hole; and a fan mounted to the rack to blow air across the container, to draw air and water vapor out of the tray compartments.

8. A container for children's oral hygiene articles, comprising:

a rack having two sidewardly spaced side panels, wherein a plurality of rails extend inwardly from each side panel;

a plurality of trays removably supported within the rack, each tray being supported on two opposed side rails, wherein each tray has a bottom wall with side walls, a rear wall, and a front wall which extend upwardly from the bottom wall, and having a plurality of partitions which extend upwardly from the bottom wall to define a plurality of compartments within the tray which are separated from one another;

a lid connected to each tray to be movable between a first position in which the lid covers the plurality of compartments, and a second position in which access is permitted to the plurality of compartments;

portions of the lid which define a plurality of air holes formed above each of the plurality of compartments in the first position, wherein the trays are positioned one above the other in the rack such that an air cavity is defined between two stacked trays and which communicates with the tray lid air holes, such that vapor within the compartments can escape from the container.

9. The container of claim 8 wherein each air hole has a diameter from about 0.040 inches to about 0.090 inches in diameter.

10. The container of claim 9 wherein each air hole has a diameter of from about 0.060 to about 0.080 inches.

11. The container of claim 8 wherein the rack has a rear panel, and wherein portions of the rear panel define at least one rear opening, and wherein the trays are supported within the rack to be vertically spaced so as to define air cavities within the rack between each pair of vertically spaced trays, and wherein portions of each side panel define at least one side opening communicating with an air cavity between trays.

12. The container of claim 8 wherein there are at least eight air holes formed in the lid above each compartment in the lid first position.

13. The container of claim 8 further comprising indicia affixed to the lid corresponding to each compartment, the indicia indicating the identity of the owner of the oral hygiene articles contained within that compartment.

14. The container of claim 8 further comprising a compartment insert removably positioned within each compartment, the compartment insert having a plurality of upwardly extending ribs, such that when positioned within a compartment the insert supports the oral hygiene article so that it is not in continuous contact with an underlying support surface.

15. The container of claim 8 further comprising:

a rear panel extending between the rack side panels, wherein portions of the rear panel define at least one air hole; and a fan mounted to the rack to blow air through the at least one air hole across the containers, to draw air and water vapor out of the tray compartments.

16. The container of claim 8 further comprising indicia on the container corresponding to each compartment, the indicia indicating the identity of the owner of the oral hygiene articles contained within that compartment.

17. An assembly of a container and a plurality of children's toothbrushes, comprising:

a rack having two sidewardly spaced side panels;

a plurality of trays removably supported within the rack, in vertically spaced relation, wherein each tray has a bottom wall with side walls, a rear wall, and a front wall which extend upwardly from the bottom wall, and having a plurality of partitions which extend upwardly from the bottom wall to define a plurality of compartments within the tray which are separated from one another;

a children's toothbrush positioned within each compartment;

a lid connected to each tray to be movable between a first position in which the lid covers the plurality of compartments, and a second position in which access is permitted to the plurality of compartments; and portions of the lid which define a plurality of air holes formed above each of the plurality of compartments in the first position, wherein the trays are positioned one above the other in the rack such that an air cavity is defined between two stacked trays and which communicates with the tray lid air holes, such that vapor within the compartments can escape from the container.

18. The container of claim 17 wherein each air hole has a diameter from about 0.040 inches to about 0.090 inches in diameter.

19. The container of claim 17 wherein the rack has a rear panel, and wherein portions of the rear panel define at least one rear opening, and wherein the trays are supported within the rack to be vertically spaced so as to define air cavities within the rack between each pair of vertically spaced trays, and wherein portions of each side panel define at least one side opening communicating with an air cavity between trays.

20. The container of claim 17 further comprising indicia affixed to the lid corresponding to each compartment, the indicia indicating the identity of the owner of the oral hygiene articles contained within that compartment.

21. The container of claim 17 further comprising a compartment insert removably positioned within each compartment, the compartment insert having a plurality of upwardly extending ribs, such that when positioned within a compartment the insert supports the oral hygiene article so that it is not in continuous contact with an underlying support surface.

22. The container of claim 17 further comprising:

a rear panel extending between the rack side panels, wherein portions of the rear panel define at least one air hole; and a fan mounted to the rack to blow air through the at least one air hole across the containers, to draw air and water vapor out of the tray compartments.

23. The container of claim 17 further comprising indicia on the container corresponding to each compartment, the indicia indicating the identity of the owner of the oral hygiene articles contained within that compartment.

* * * * *